US006134413A

United States Patent [19]

Asanae et al.

[11] Patent Number: 6,134,413

[45] Date of Patent: Oct. 17, 2000

[54] CARRIER FOR MAGNETIC DEVELOPER AND METHOD OF ELECTROPHOTOGRAPHICALLY FORMING VISUAL IMAGE

[75] Inventors: Masumi Asanae; Tsutomu Saitoh, both of Kumagaya; Takashi Hayano, Honjo, all of Japan

[73] Assignee: Hitachi Metals, Ltd., Tokyo, Japan

[21] Appl. No.: 08/962,265

[22] Filed: Oct. 31, 1997

Related U.S. Application Data

[63] Continuation of application No. 08/588,786, Jan. 19, 1996, abandoned.

[30] Foreign Application Priority Data

Jan. 20, 1995 [JP] Japan ..... 7-006887

[51] Int. Cl.[7] ..... G03G 15/09

[52] U.S. Cl. ..... 399/267; 430/105; 430/108; 430/111

[58] Field of Search ..... 399/53, 222, 252, 399/265, 267; 430/105, 106.6, 108, 109, 111

[56] References Cited

U.S. PATENT DOCUMENTS

| | | | |
|---|---|---|---|
| 4,309,498 | 1/1982 | Yamashita et al. | 430/100 |
| 4,898,801 | 2/1990 | Tachibana et al. | 430/106.6 |
| 5,256,513 | 10/1993 | Kawamura et al. | 430/106.6 |
| 5,272,037 | 12/1993 | Ohtani et al. | 430/108 |
| 5,342,721 | 8/1994 | Akamatsu | 430/108 |
| 5,346,791 | 9/1994 | Ozawa et al. | 430/106.6 |
| 5,483,329 | 1/1996 | Asanae et al. | 399/267 X |
| 5,576,134 | 11/1996 | Ogawa et al. | 430/108 X |

FOREIGN PATENT DOCUMENTS

| | | |
|---|---|---|
| 2-210365 | 8/1990 | Japan . |
| 5-150538 | 6/1993 | Japan . |
| 5-150558 | 6/1993 | Japan . |

*Primary Examiner*—Sandra Brase
*Attorney, Agent, or Firm*—Morgan, Lewis & Bockius LLP

[57] ABSTRACT

A magnetic carrier for a developer used in electrostatically forming a visual image, comprising a magnetic core material, an electrically-conductive particle-containing resin layer and electrically-conductive particles externally added to the electrically-conductive particle-containing resin layer, the magnetic carrier having a magnetization ($\sigma_{1000}$) of 61–100 emu/g at 1 kOe magnetic field, a specific volume resistance of $10^6$ Ω·cm or less, and an average particle size of 10–100 μm. The magnetic carrier of low specific volume resistance has a high durability and provides high quality images. In particular, when the magnetic carrier is applied to an image forming process by rear side exposure, the residual toner on the image-bearing member can be effectively removed without using an additional cleaning means, and high quality images free from the background fogging and contamination can be produced.

5 Claims, 1 Drawing Sheet

CARRIER FOR MAGNETIC DEVELOPER AND METHOD OF ELECTROPHOTOGRAPHICALLY FORMING VISUAL IMAGE

This application is a continuation of application Ser. No. 08/588,786, filed Jan. 19, 1996, now abandoned.

BACKGROUND OF THE INVENTION

The present invention relates to a carrier of low electrical resistance for use in a two-component magnetic developer and a method of electrophotographically forming visual image using the carrier.

It is known that electrophotographic processes and electrostatic recording or printing methods are generally used to duplicate or reproduce an analog or digital data such as characters, graphics, etc. For instance, in an electrophotographic copying machine or facsimile, a photosensitive layer or dielectric layer is charged to a uniform potential and the charged portion is exposed to light image of original data to form a electrostatic latent image. The latent image is developed by bringing a magnetic brush into contact with the latent image, thereby adhering a toner to the latent image to form a visual toner image. Generally, the toners used there are those which are electrostatically chargeable to a polarity by a frictional contact with carrier particles, or magnetic toners which are composed primarily of a magnetic powder and a resin binder. However, such an electrophotographic image-forming method requires the electrophotographic copying apparatus to have an electrostatic latent image-forming means including charging unit, in addition to a developing means, to uniformly charge a surface of an image-bearing member, resulting in complicated structure, large-scale equipment, etc.

There has been proposed a method in which a light-transmitting image-bearing member is exposed to a light image corresponding to an original image from a back side to form an electrostatic latent image on a surface of the image-bearing member, and the latent image is developed simultaneously by selectively attracting thereon a magnetic conductive toner in a developer which is supplied by a developing roll composed of a permanent magnet and a sleeve. The developed image is then transferred and fixed onto a recording sheet.

Although such recording method employing a rear side exposure shows a good developability because a magnetic toner having a specific volume resistance of $10^4$–$10^{12}$ Ω·cm (so-called medium electric resistance) is used, the transferring efficiency of the developed image to a recording sheet is low. Namely, the developed image is not completely transferred onto a recording sheet even when a corotron which is a most general transferring means is used, thereby resulting in blurred image. Therefore, an ordinary paper has not been used in a recording method employing a rear side exposure.

After transferring the developed toner image to a recording sheet, a small amount of the toner is likely to remain on the photosensitive surface of an image-bearing member. Thus, a cleaning device is generally provided to remove the residual toner from the image-bearing member. To this end, a space for installing the cleaning device must be provided in the vicinity of the image-bearing member, failing to achieve an intended miniaturization of an electrophotographic recording apparatus.

When a mixture of a toner and a magnetic carrier is used as the developer, the surface of the magnetic carrier is generally coated with a resin material to improve the durability thereof and control the electrostatic charge of the toner. However, such resin coating is not desirable because it causes various drawbacks such as high specific volume resistance of the magnetic carrier, reduction in developability, low cleaning efficiency of the toner remaining on the photosensitive surface of an image-bearing member, etc. To control the specific volume resistance of the magnetic carrier, there has been known a method where the surface of the carrier particle is partially or completely coated with a resin containing an electrically-conductive particles such as carbon black and metal power, or a method where electrically-conductive particles are added to the carrier after the whole or partial surface of the carrier is coated with a resin. However, the former method cannot reduce the specific volume resistance of the carrier sufficiently. Although the increased content of the electrically-conductive particles can reduce the specific volume resistance, the formed coating layer involves various disadvantages such as easy peeling, etc. In the later method, the detached electrically-conductive particles likely contaminate the surface of the image-bearing member because the adhering force of the electrically-conductive particles to the resin layer is low.

For the two-component developer for use in usual electrophotography, it has been proposed to add the electrically-conductive particles onto the surface of resin-coated magnetic carrier to improve the image quality. However, the same problems mentioned above are involved also in this case.

OBJECT AND SUMMARY OF THE INVENTION

Accordingly, an object of the present invention is to provide a magnetic carrier for use in a magnetic developer free from the above disadvantages in the prior art, i.e., a magnetic carrier free from scattering of the adhered electrically-conductive particles therefrom and low in the specific volume resistance.

Another object of the present invention is to provide an image forming method by rear side exposure which is free from the above disadvantages in the prior art and produces images of high quality.

As a result of the intense research in view of the above objects, the inventors have found that the above object can be attained by a magnetic carrier produced by coating a magnetic core material with a resin material containing electrically-conductive particles and further externally adding to the resin layer electrically-conductive particles to provide the resulting carrier with specific properties.

The inventors have further found that the above object can be attained by an image forming method employing rear side exposure while using a developer consisting of a mixture of a chargeable toner and the above magnetic carrier.

Thus, in a first aspect of the present invention, there is provided a magnetic carrier for a developer used in electrostatically forming a visual image, comprising a magnetic core material, an electrically-conductive particle-containing resin layer formed on a partial or complete surface of the magnetic core by coating a resin material containing the electrically-conductive particles, and electrically-conductive particles externally added to the electrically-conductive particle-containing resin layer, the magnetic carrier having a magnetization ($\sigma_{1000}$) of 61–100 emu/g at 1 kOe magnetic field, a specific volume resistance of $10^6$ Ω·cm or less, and an average particle size of 10–100 μm.

In a second aspect of the present invention, there is provided a method of electrostatically forming a visual image on a recording sheet, comprising (1) electrostatically charging a surface of a rotating hollow cylindrical image-bearing member made of a light-transmitting material to a uniform potential; (2) exposing the electrostatically charged portion of the image-bearing member to a light image of original informational data being reproduced from a rear side to form an electrostatic latent image corresponding to the original informational data; (3) transporting a magnetic developer to a developing zone defined by a gap between the image-bearing member and a non-magnetic, hollow cylindrical sleeve containing inside thereof a permanent magnet roll having a plurality of magnetic poles on the surface thereof, the magnetic developer being attracted on the surface of the sleeve and transported to the developing zone by a relative rotation between the sleeve and the permanent magnet roll; (4) developing the latent image by bringing the magnetic developer into contact therewith in the developing zone to form a toner image on the image-bearing member; (5) transferring the developed toner image onto a recording sheet; and (6) fixing the transferred toner image to the recording sheet; the magnetic developer being a mixture of a chargeable toner having a specific volume resistance of $10^{13}$ Ω·cm or more and an average particle size of 4–20 μm and a magnetic carrier having a magnetization ($\sigma_{1000}$) of 61–100 emu/g at 1 kOe magnetic field, a specific volume resistance of $10^{6}$ Ω·cm or less, and an average particle size of 10–100 μm.

DETAILED DESCRIPTION OF THE INVENTION

Figure 1:
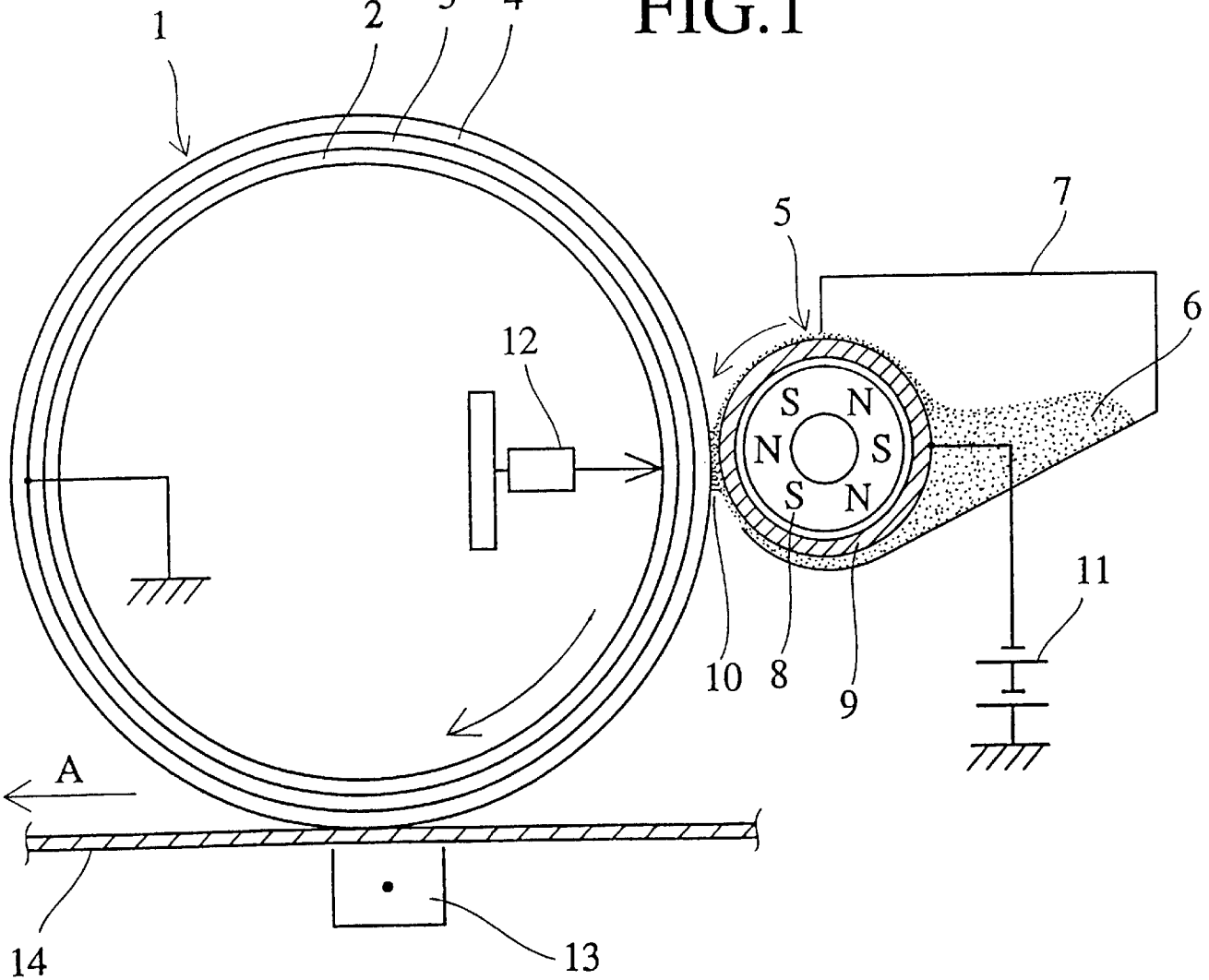
FIG. 1 is a schematic cross sectional view showing an electrophotographic recording apparatus for putting the method according to the present invention into practice.

The present invention will be described below more in detail.

[Toner]

The toner used in the present invention is of chargeable type. The chargeable toner is desired to have a specific volume resistance of $10^{13}$ Ω·cm or more at an electric field of D.C. 4000 V/cm to enhance the transferring efficiency and minimize the amount of the toner remaining on the surface of the image-bearing member.

The chargeable toner may be non-magnetic or magnetic, and may be produced by mixing a binder resin, a magnetic powder and a charge-controlling agent in a predetermined ratio and following a known method such as a pulverization method, spray-drying method, etc. A flowability improver such as silica fine powder and/or a resistance-controlling agent such as carbon black, etc. may be added to the chargeable toner internally and/or externally.

The chargeable toner preferably has a volume-average particle size of 4–20 μm, more preferably 6–16 μm. When a particle size of the toner is too small, background fogging and toner scattering may occur. On the other hand, when the particle size is too large, resolution and developability of the toner image are undesirably lowered.

The binder resin for the chargeable toner may include those mentioned below.

When a heat-fixing system using an oven or heat roll is employed, suitable examples of the binder resin are thermoplastic vinyl resins including homopolymers and copolymers of styrene compounds, vinyl esters, esters of α-methylene-aliphatic monocarboxylic acids, acrylonitrile, methacrylonitrile, acrylamides, vinyl ethers, vinyl ketones, N-vinyl compounds, etc. The above homopolymers and copolymers may be used alone or in combination. Further, non-vinyl thermoplastic resins such as bisphenol-type epoxy resins, oil-modified epoxy resins, polyurethane resins, cellulose resins, polyether resins, polyester resins, etc. may be used alone or in combination with the above thermoplastic vinyl resins.

When the pressure-fixing system is employed, examples of the binder resin for the chargeable toner may include pressure-sensitive compounds and resins such as higher aliphatic acids, higher aliphatic acid derivatives, higher aliphatic acid amides, waxes, rosin derivatives, alkyd resins, epoxy-modified phenol resins, natural resin-modified phenol resins, amino resins, silicone resins, urea resins, oligomers of (meth)acrylic acid and long-chain alkyl (meth)acrylate, polyolefins, ethylene/vinyl acetate copolymers, ethylene/vinyl alkyl ether copolymers, maleic acid anhydride-type copolymers, etc.

Any of the above resins may be used alone or in combination. However, in view of flowability of the toner, it is preferred that the resins or resin mixtures have a glass-transition temperature of greater than 40° C.

The magnetic powder for the magnetic toner may be powder of an alloy and compound containing a ferromagnetic element such as iron, cobalt, nickel, etc., for example, ferrite powder, magnetite powder, etc. The number-average particle size of the magnetic powder is preferably 0.1–3 μm, and the content of the magnetic powder in the chargeable toner is preferably 10–70 weight %, more preferably 20–60 weight %. The number-average particle size was calculated from the size measured on 250 particles randomly selected from transmission electron microscope photograph (×40000). A content less than 10 weight % makes the resultant toner detachable from the surface of the sleeve due to an insufficient magnetic force. A content exceeding 70 weight % reduces the specific volume resistance of the resultant toner because the magnetic powder is electrically-conductive. This results in the deterioration of both the transferring efficiency and fixing property.

The charge-controlling agent usable in the chargeable toner may include known dyes and pigments. For example, positively triboelectrically-chargeable nigrosine dyes, nigrosine dyes modified with a higher aliphatic carboxylic acid, negatively triboelectrically-chargeable azo dyes containing a metal such as Cr, etc. may be exemplified. The content of the charge-controlling agent in the chargeable toner may be selected depending on the desired electrostatic charge of the chargeable toner, and preferably 1–10 weight %.

[Carrier]

The core material for the magnetic carrier of the present invention may include a powder of a metal such as iron, a powder of an oxide such as magnetite, ferrite, etc. Preferred is a powder of ferrite which is a sintered product consisting of a metal oxide and an iron(III) oxide, and typical example thereof includes Ba—Ni—Zn ferrite, Mn—Zn ferrite, Ni—Zn ferrite, Li—Zn ferrite, Cu—Zn ferrite, Cu—Zn—Mg ferrite, Mg—Zn ferrite, etc. The ferrite powder may be produced by calcining for 0.5–3.0 hours a mixture of the starting materials in a predetermined ratio, pulverizing the calcined mixture to fine powders of 2.0 μm average particle size, making the fine powders into granules of predetermined particle size, sintering the granules for 3–5 hours at 900–1350° C., disintegrating the sintered product, and classifying the powder. The core material produced as mentioned above is preferred to have a weight-average particle size of 20–50 μm. The shape may be spherical or nonspherical, and a particle having a large specific surface area such as a flat particle and a particle having irregularly roughened surface is preferable.

The core material is coated on its whole or partial surface with a resin material containing electrically-conductive particles such as carbon black, metal powder, etc. The resin material to form the electrically-conductive particle-containing resin layer may include silicone resins, styrene-acrylic resins, polyester resins, maleic acid resins, acrylic resins, etc. The metal powder is preferred to be an electrically conductive and stable fine powder, and may include a powder of metal such as Ni, Al, Cu, alloy thereof, sendust, etc.

A hardening agent may be added to the resin material to enhance the fixing between the core material and the resin layer. A heat-hardening compound such as melamine, amine salts, etc. may be used as the hardening agent.

Further, a small amount of phenol resins, urea resins, alkyd resins, fillers, diluents, flexibilizers, etc. may be added to the resin material to improve the adhesion property of the resin layer to the core material, improve the wear resistance, prevent the toner from fusing to the resin layer, control the charge of the toner, and provide the developer with a sufficient flowability.

The amount of the electrically-conductive particle-containing resin material to be coated on the magnetic core material is preferably 0.5–3 weight % of the magnetic core material. An amount less than 0.5 weight % is not desired because of decreased durability of the magnetic carrier. An amount exceeding 3 weight % disadvantageously causes background fogging. The content of the electrically-conductive particle in the electrically-conductive particle-containing resin material is preferably 10–20 weight %.

The electrically-conductive particle is externally added to the surface of the electrically-conductive particle-containing resin layer. The same carbon black and a metal powder which may be contained in the resin layer may be used as the external electrically-conductive particle. The addition amount of the electrically-conductive particle is 2 weight % or less (excluding zero), preferably 1–2 weight % based on the magnetic core material. An addition amount exceeding 2 weight % is not desirable because background fogging and contamination of the image-bearing member occur.

The magnetic carrier of the present invention may be produced, for example, in the following manner.

First, the resin material is dissolved in an adequate solvent such as benzene, toluene, xylene, methyl ethyl ketone, tetrahydrofuran, chloroform, hexane, etc., to produce a resin solution or emulsion. To this solution or emulsion, a predetermined amount of electrically-conductive particle is added and thoroughly mixed to give a uniform mixture. The mixture is sprayed onto the magnetic core material to form a uniform resin layer on the whole or partial surface of the magnetic core material. To obtain the uniform resin layer, the magnetic core material is preferably maintained in a fluidized state desirably by employing a spray dryer or a fluidized bed. The resin/electrically-conductive particle mixture is sprayed at about 200° C. or lower, preferably at about 100–150° C., to simultaneously carry out the rapid removing of a solvent from the resultant resin layer and the drying of the resin layer. The resin emulsion containing the electrically-conductive particle is sprayed at a temperature from room temperature to 100° C. to adhere the fused resin on the surface of the magnetic core material.

The electrically-conductive particle is externally added to the electrically-conductive particle-containing resin layer thus formed on the magnetic core material, for example, by dry-mixing the magnetic core coated with the electrically-conductive particle-containing resin and the electrically-conductive particle to be externally added in a mixer such as a super mixer.

The magnetic carrier thus produced has a magnetization ($\sigma_{1000}$) of 61–100 emu/g, preferably 65–90 emu/g at 1 kOe magnetic field, a specific volume resistance of $10^6$ Ω·cm or less, preferably $10^3$–$10^4$ Ω·cm, and a weight-average particle size of 10–100 μm, preferably 20–50 μm.

When $\sigma_{1000}$ is 60 emu/g or less, the magnetic developer is not transported efficiently, and also the magnetic carrier contaminates the surface of the image-bearing member. On the other hand, $\sigma_{1000}$ exceeding 100 emu/g leads to decreased developability.

A specific volume resistance exceeding $10^6$ Ω·cm is undesirable because images of a low density are produced due to insufficient charge transfer from the image-bearing member, and because the charge is hardly dissipated during the removing operation of the residual toner, resulting in many foggings.

A magnetic carrier having an average particle size less than 10 μm likely adheres on the image-bearing member, and a magnetic carrier having an average particle size larger than 100 μm likely provide images of low resolution.

[Developer]

The magnetic developer used in the present invention is prepared by mixing the chargeable toner and the magnetic carrier. When the magnetic chargeable toner is used, the content of the toner in the developer is preferably 10–90 weight %. When the toner content is less than 10 weight % (the carrier content larger than 90 weight %), the magnetic carrier agglomerates together and likely adheres on the image-bearing member. When the toner content is larger than 90 weight % (the carrier content less than 10 weight %), the amount of spent toner increases due to the toner scattering to reduce the lifetime of the magnetic carrier.

When the non-magnetic toner is used, the toner content in the developer is preferably 5–40 weight % for the same reason above.

[Method of forming images]

FIG. 1 is a cross sectional view schematically showing an electrophotographic recording apparatus for practicing the method of the present invention.

The hollow cylindrical image-bearing member 1 comprises a support layer 2 made of a transparent material such as glass, a light-transmitting electrically-conductive layer 3 formed on the support layer 2, and a photosensitive layer 4 made of a light-transmitting photosemiconductive material and formed on the electrically-conductive layer 3. The image-bearing member 1 is disposed so as to rotate, for example, in the clockwise direction as indicated by the arrow in FIG. 1. A protective layer made of a wear-resistant material may be formed on the photosensitive layer 4, if desired. The image-bearing member 1 is also made into an endless belt movable around a pair of pulleys made of electrically-conductive material.

A developing means is disposed opposite to the image-bearing member 1. The developing means comprises a hopper 7 storing a magnetic developer 6 and a developing roll 5 partially received in the hopper 7. The developing roll 5 contacts with the surface of the image-bearing member 1 through the magnetic brush of the developer 6. The image-bearing member 1 and the developing roll 5 cooperate to define a developing gap and a developing zone 10 where a latent image on the image-bearing member 1 is developed by a magnetic developer 6 to form a visual toner image. The developing gap is suitably not greater than 1.0 mm to ensure the contact of the magnetic brush with the surface of the image-bearing member 1 and a recovery of a residual toner from the surface of the image-bearing member 1. On the other hand, the developing gap should be not less than 0.2 mm to achieve a soft contact of the magnetic brush with the surface of the image-bearing member 1. The preferred developing gap is 0.3–0.6 mm. A doctor gap between a doctor blade and a sleeve 9 may be determined properly depending upon the developing gap.

The developing roll 5 comprises an inner permanent magnet member 8 provided with a plurality of magnetic poles on the surface, and an outer hollow cylindrical sleeve 9 made of a non-magnetic material such as aluminum alloy, etc. The sleeve 9 is disposed coaxially with the permanent magnet member 8.

The magnetic developer 6 is transported from the hopper 7 to the developing zone 10. In the method of the present invention, the delivery method of the magnetic developer to a developing zone 10 is not specifically restricted, but the magnetic developer 6 is preferably delivered by a method where at least the sleeve 9 is rotated to prevent the magnetic carrier from magnetically agglomerating together. Therefore, the delivery of the magnetic developer may be performed by a developing roll in which only the sleeve 9 is rotatable, both the sleeve 9 and the permanent magnet member 8 are rotatable in the same direction (U.S. Pat. No. 4,309,498), or both the sleeve 9 and the permanent magnet member 8 are rotatable in the opposite directions. In addition, the sleeve 9 is electrically connected with a bias voltage source 11 so that a bias voltage is applied to the sleeve 9.

A light image exposing means 12 is mounted inside the image-bearing member 1 in opposition to the developing zone 10 so that the outer surface of the image-bearing member 1 may be subjected to rear side exposure to a light image corresponding to an original image being reproduced. A transfer means 13 is disposed in the vicinity of the image-bearing member 1. A recording sheet 14 is supplied between the image-bearing member 1 and the transfer means 13 in a direction indicated by the arrow A and then delivered to a fixing means (not shown).

With the electrostatically recording apparatus having the above construction, a printed image is reproduced on a recording sheet as described below.

First, the magnetic developer 6 transported to the developing zone 10 by the rotating sleeve 9 forms magnetic brush which brushes the surface of the image-bearing member 1 with a certain width to provide the surface of the image-bearing member 1 with triboelectric charge or potential, thereby electrostatically charging the surface of the image-bearing member 1 to a uniform potential. Alternatively, a charging means such as scorotron, charging brush, charging rubber roll, etc. may be disposed in the upstream side of the developing zone 10 with respect to the rotating direction of the image-bearing member 1 to provide the image-bearing member 1 with a constant electrostatic charge.

Then the image-bearing member 1 is exposed from the rear side to the light image corresponding to the original image from the light image exposing means 12. Exposure of the charged surface of the image-bearing member 1 selectively dissipates the charge thereon in the irradiated areas, while remaining the charge in the non-irradiated areas unchanged to record an electrostatic latent image on the image-bearing member 1 corresponding to the original information being reproduced. The non-irradiated areas and the developing roll 5 has the same potential, whereas a potential difference occurs between the irradiated areas and the developing roll 5. This forms a toner image on the image-bearing member 1 by attracting the toner in the magnetic developer 6 to the irradiated areas. The developed toner image moves by a further rotation of the image-bearing member 1 into a transfer zone where the toner image is transferred onto the recording sheet 14 delivered between the image-bearing member 1 and the transfer means 13. The transferred toner image is then fixed by a fixing means (not shown) to the recording sheet 14.

Although the method of forming images by rear side exposure has been described above, the magnetic carrier of the present invention can be also applied to other image forming methods.

The present invention will be further described while referring to the following Examples which should be considered to illustrate various preferred embodiments of the present invention.

EXAMPLES 1–6 AND COMPARATIVE EXAMPLES 1–6

Preparation of Chargeable Toner

A starting mixture consisting, by weight part, of:

- 50 parts of styrene/n-butyl methacrylate copolymer (number-average molecular weight (Mn)=$1.6\times10^4$, weight average-molecular weight (Mw)=$21\times10^4$),
- 45 parts of magnetite (EPT500 manufactured by Toda kogyo K.K.),
- 3 parts of polypropylene (TP32 manufactured by Sanyo Chemical Industries, Ltd.), and
- 2 parts of a negatively chargeable charge-controlling agent (Bontron E-81 manufactured by Orient Chemical Industries)

was kneaded in a kneader equipped with a heating roll for 30 minutes. After cooling and solidifying, the mixture was pulverized and classified to obtain a particle having a volume-average particle size of 10 $\mu$m. In a hot air flow of 120° C., 100 parts by weight of the particle was uniformly coated with 0.5 parts by weight of hydrophobic silica (Aerosil R972 manufactured by Nippon Aerosil K.K.), thereby producing a negatively chargeable magnetic toner. The magnetic toner had a volume specific resistance of $4\times10^{14}$ $\Omega\cdot$cm and a triboelectric charge of −23 $\mu$C/g.

Preparation of Magnetic Carrier 100 parts by weight of flat iron powder (average particle size: 30 $\mu$m) was coated with 0.3–4 parts by weight of a silicone resin containing 0–30 weight % of carbon black (MA 600 manufactured by Mitsubishi Chemical Corporation) and heat-treated at 170° C. for 30 minutes in a fluidized bed coating apparatus. After pulverization, the heat-treated mixture was classified to obtain a resin-coated iron powder having an average particle size of 10–70 $\mu$m. Thereafter, the resin-coated iron powder was further coated with 0–5 parts by weight of carbon black (MA600 manufactured by Mitsubishi Chemical Corporation) per 100 parts by weight of the iron powder in a super mixer to obtain each magnetic carrier. The specific volume resistance of each magnetic carrier is shown in Table 1 below.

The specific volume resistances of the chargeable toner and the magnetic carrier were determined as follows. An appropriate amount (several tens mg) of the chargeable toner or magnetic carrier was charged into a dial-gauge type cylinder made of Teflon (trade name) and having an inner diameter of 3.05 mm (0.073 $cm^2$ cross section). The sample was exposed to an electric field of D.C. 4000 V/cm (chargeable toner) or D.C. 200 V/cm (magnetic carrier) under a load of 0.1 kgf to measure an electric resistance using an insulation-resistance tester (4329A type manufactured by Yokogawa-Hewlett-Packard, Ltd.).

The triboelectric charge of the toner was determined as follows. A developer having a toner content of 5 weight % was mixed well, and blown at a blowing pressure of 1.0 kgf/cm$^2$. The triboelectric charge of the toner thus treated was measured by using a blow-off powder electric charge measuring apparatus (TB-200 manufactured by Toshiba Chemical Co. Ltd.).

Image Forming Test

Each of the magnetic developers of 40 weight % toner content was prepared by mixing the negative chargeable toner and the magnetic carrier obtained above. By using the magnetic developer thus prepared, the image forming test was carried out under the following conditions.

A doctor gap between the developing roll 5 and doctor blade (not shown) was adjusted to 0.3 mm to form a layer of the magnetic developer 6 with an adequate thickness on the sleeve 9. A developing gap in the developing zone 10 was adjusted to 0.4 mm.

The developing roll 5 was composed of a hollow cylindrical sleeve 9 made of stainless steel (SUS304) and having an outer diameter of 20 mm, and an 8-pole permanent magnet coaxially disposed within the sleeve 9. The surface magnetic flux density on the sleeve 9 was 700 G and the rotation speed of the sleeve 9 was adjusted to 150 rpm. The surface of the sleeve 9 was biased to −400 V.

The photosensitive layer 4 of the image-bearing member 1 of 40 mm diameter was made of a negatively chargeable photosemiconductive material. The peripheral speed of the image-bearing member 1 was 150 mm/sec and the surface thereof was corona-charged to −500 V.

The developed toner image was transferred and fixed on the recording sheet by a heat roll at 190° C. under a line pressure of 1 kg/cm.

The results of the test are shown in Table 1.

TABLE 1

| | Magnetic Carrier | | | | | |
|---|---|---|---|---|---|---|
| | Amount of resin layer (part by wt.) | Carbon black content (wt. %) | Amount of external carbon black (part by wt.) | Specific volume resistance (Ω · cm) | Magnetization ($\sigma_{1000}$) (emu/g) | Average particle size (μm) |
| Example | | | | | | |
| 1 | 3 | 10 | 2 | $10^5$ | 65 | 30 |
| 2 | 3 | 20 | 2 | $10^3$ | 65 | 30 |
| 3 | 3 | 10 | 1 | $10^6$ | 65 | 30 |
| 4 | 2.5 | 10 | 2 | $10^5$ | 65 | 30 |
| 5 | 2 | 10 | 2 | $10^4$ | 65 | 30 |
| 6 | 1 | 10 | 2 | $10^3$ | 65 | 30 |
| Comparative Example | | | | | | |
| 1 | 3 | — | 2 | $10^7$ | 65 | 30 |
| 2 | 3 | — | 5 | $10^3$ | 65 | 30 |
| 3 | 3 | 10 | — | $10^{10}$ | 65 | 30 |
| 4 | 0.3 | 10 | 2 | $10^6$ | 65 | 30 |
| 5 | 4 | 10 | 2 | $10^8$ | 65 | 30 |
| 6 | 3 | 30 | 2 | $10^2$ | 65 | 30 |

| | Image Density | Resolution (lines/mm) | Background Fogging | Contamination by Carbon Black | Durability | Total Evaluation |
|---|---|---|---|---|---|---|
| Example | | | | | | |
| 1 | 1.32 | 10 | none | none | good | good |
| 2 | 1.41 | 10 | none | none | good | good |
| 3 | 1.39 | 10 | none | none | good | good |
| 4 | 1.38 | 10 | none | none | good | good |
| 5 | 1.40 | 10 | none | none | good | good |
| 6 | 1.43 | 10 | none | none | good | good |
| Comparative Example | | | | | | |
| 1 | 1.37 | 8 | occurred | none | poor | poor |
| 2 | 1.45 | 8 | occurred | occurred | poor | poor |
| 3 | 1.10 | 6 | occurred | none | good | poor |
| 4 | 1.39 | 10 | none | none | poor | poor |
| 5 | 1.27 | 6 | occurred | none | good | poor |
| 6 | 1.27 | 8 | occurred | occurred | good | poor |

Since the magnetic carrier had the silicone resin coating layer containing no carbon black and had only the external carbon black, both the magnetic carriers of Comparative Examples 1 and 2 showed poor durability. Further, since the amount of the external carbon black is too much, both the background fogging and contamination by the scattered carbon black occurred in Comparative Example 2. The magnetic carrier of Comparative Example 3 showed a high specific volume resistance because contained carbon black only in the resin layer, resulting in a low image density, a low resolution and occurrence of background fogging.

The magnetic carriers of Comparative Examples 4–6 had both the resin layer containing carbon black and the external carbon black. However, the magnetic carrier of Comparative Example 4 is poor in the durability because of a small amount of the carbon black-containing resin layer. The specific volume resistance of the carrier of Comparative Example 5 was too high due to the large amount of the carbon black-containing resin layer, resulting in a low image density, a low resolution and occurrence of background fogging. Since the carbon black contained in the resin layer was too much, the image density was low and the background fogging and the contamination by carbon black were observed in Comparative Example 6.

As compared with the above Comparative Examples, since the resin layer contained a suitable amount of carbon black and a suitable amount of carbon black was externally added to the resin layer, Examples 1–6 showed a good durability of the magnetic carrier and was free from the background fogging and the contamination by carbon black, resulting in high quality images of a high image density and resolution.

What is claimed is:

1. A magnetic carrier for a developer used in electrostatically forming a visual image, comprising a magnetic core material, an electrically-conductive particle-containing resin layer formed on a partial or complete surface of said magnetic core by coating a resin material containing said electrically-conductive particles, and electrically-conductive particles externally added to said electrically-conductive particle-containing resin layer, said magnetic carrier having a magnetization ($\sigma_{1000}$) of 61–100 emu/g at 1 kOe magnetic field, a specific volume resistance of $10^6$ Ω·cm or less, and an average particle size of 10–100 μm.

2. The magnetic carrier according to claim 1, wherein the amount of said electrically-conductive particle-containing resin layer is 0.5–3 weight % of the amount of said magnetic core material.

3. The magnetic carrier according to claim 1, wherein the content of said electrically-conductive particles in said resin material containing said electrically-conductive particles is 10–20 weight %.

4. The magnetic carrier according to claim 1, wherein the amount of said electrically-conductive particles externally added to said electrically-conductive particle-containing resin layer is 2 weight % or less, excluding 0%, of the amount of said magnetic core material.

5. A method of electrostatically forming a visual image on a recording sheet, comprising:

electrostatically charging a surface of a rotating hollow cylindrical image-bearing member made of a light-transmitting material to a uniform potential;

exposing the electrostatically charged portion of said image-bearing member to a light image of original informational data being reproduced from a rear side to form an electrostatic latent image corresponding to said original informational data;

transporting a magnetic developer to a developing zone defined by a gap between said image-bearing member and a non-magnetic, hollow cylindrical sleeve containing inside thereof a permanent magnet roll having a plurality of magnetic poles on the surface thereof said magnetic developing being attracted on the surface of said sleeve and transported to said developing zone by a relative rotation between said sleeve and said permanent magnet roll;

developing said latent image by bringing said magnetic developer into contact therewith in said developing zone to form a toner image on said image-bearing member;

transferring said developed toner image onto a recording sheet; and fixing said transferred toner image to said recording sheet;

said magnetic developer being a mixture of a chargeable toner having a specific volume resistance of $10^{13}$ Ω·cm or more and an average particle size of 4–20 μm and a magnetic carrier having a magnetization ($\sigma_{1000}$) of 61–100 emu/g at 1 KOe magnetic field. a specific volume resistance of $10^{6}$ Ω·cm or less, and an average particle size of 10–100 μm, wherein said magnetic carrier comprises a magnetic core material, an electrically-conducive particle-containing resin layer formed on a partial or complete surface of said magnetic core by coating a resin material containing said electrically-conductive particles, and electrically-conductive particles externally added to said electrically-conductive particle-containing resin layer.

* * * * *